US005942978A

United States Patent [19]

Shafer

[11] Patent Number: 5,942,978

[45] Date of Patent: Aug. 24, 1999

[54] WIRELESS TRANSMITTER KEY FOR EAS TAG DETACHER UNIT

[75] Inventor: Gary Mark Shafer, Boca Raton, Fla.

[73] Assignee: Sensormatic Electronics Corporation, Boca Raton, Fla.

[21] Appl. No.: 09/115,821

[22] Filed: Jul. 15, 1998

Related U.S. Application Data

[63] Continuation-in-part of application No. 09/065,507, Apr. 24, 1998.

[51] Int. Cl.[6] ..... G08B 13/14

[52] U.S. Cl. ..... 340/572.9; 340/572.8; 340/572.1; 340/825.54; 70/57.1

[58] Field of Search ..... 340/572, 551, 340/568, 825.54, 572.1, 572.8, 572.9, 568.1; 70/57.1, 391, 416, 453, 454; 24/704.1, 704.2

[56] References Cited

U.S. PATENT DOCUMENTS

| | | | |
|---|---|---|---|
| 4,553,136 | 11/1985 | Anderson, III et al. | 340/572 |
| 4,575,624 | 3/1986 | Klinkhardt | 340/572 |
| 5,151,684 | 9/1992 | Johnsen | 340/572 |
| 5,426,419 | 6/1995 | Nguyen et al. | 340/572 |
| 5,587,703 | 12/1996 | Dumont | 340/572 |

*Primary Examiner*—Benjamin C. Lee
*Attorney, Agent, or Firm*—Robin, Blecker & Daley

[57] ABSTRACT

A device for removing reusable "hard" EAS tags from articles of merchandise is controlled so as to operate in response to identification data generated by an RFID element in the hard tag. A transmitter-key device is provided to selectively condition the detaching unit to operate in the absence of the otherwise required identification data. The transmitter-key device may also be used to turn the detaching unit on and off. Data indicative of the identity of the holder of the transmitter-key device may be stored in the detaching unit or an associated point-of-sale terminal to log detaching transactions authorized by the transmitter-key device.

14 Claims, 10 Drawing Sheets

DETACHER/RFID READER/WRITER

RFID SYSTEM COMPONENTS

DETACHER/RFID READER/WRITER

RFID CHIP

RFID CHIP SOFTWARE

P.O.S. TERMINAL-DETACHER HANDLING SOFTWARE

WIRELESS TRANSMITTER KEY FOR EAS TAG DETACHER UNIT

CROSS-REFERENCE TO RELATED APPLICATION

This is a continuation-in-part of co-pending prior application Ser. No. 09/065,507, filed Apr. 24, 1998, which has a common inventor with this application.

FIELD OF THE INVENTION

This invention relates to electronic article surveillance (EAS) systems, and, more particularly, to devices for detaching reusable EAS tags from articles of merchandise.

BACKGROUND OF THE INVENTION

Electronic article surveillance systems are well known and are used for purposes of inventory control and to prevent theft and unauthorized removal of articles from a controlled area. Typically, in such systems, a system transmitter and a system receiver are used to establish a surveillance zone which must be traversed by any articles being removed from the controlled area.

An EAS tag is affixed to each article and includes a marker or sensor adapted to interact with a signal that is transmitted by the system transmitter into the surveillance zone. This interaction causes a further signal to be established in the surveillance zone, which further signal is received by the system receiver. Accordingly, upon movement of a tagged article through the surveillance zone, a signal will be received by the system receiver, indicating the unauthorized presence of the tagged article in the zone.

Certain types of EAS tags have been designed to be reusable and, thus, include releasable attachment devices for affixing the tags to the articles. Such attachment devices are further designed to be releasable by authorized personnel only, so that unauthorized removal of a tag from its article is avoided. To this end, many attachment devices are made releasable only through the use of an associated special tool or detaching mechanism. Examples of detaching units which may be employed to separate reusable, removable EAS tags from articles of merchandise are disclosed in U.S. Pat. Nos. 5,426,419; 5,528,914; and 5,535,606. (The disclosures of these three patents are incorporated herein by reference.) The detaching units disclosed in these patents are designed to operate upon a two-part "hard" EAS tag, formed of a molded plastic enclosure portion which houses EAS marker elements, and a tack or pin member which is inserted through an article of merchandise to be protected (such as an item of clothing) and then also inserted into the enclosure portion of the tag. The enclosure portion of the tag includes a clamp for securely holding the pin in the enclosure portion.

The detaching unit disclosed in the three patents is operated to insert a probe into the enclosure portion of the tag to release the clamp. The pin may then be released from the enclosure portion of the tag, and the tag removed from the article of merchandise. A detaching device which embodies teachings of the '419, '914 and '606 patents is sold by the assignee of this patent application, Sensormatic Electronics Corporation, as Model No. MK200.

One problem that must be faced in connection with removable EAS tags is the possibility of unauthorized removal of the tag from the article of merchandise for the purpose of defeating the EAS system. To prevent unauthorized removal of hard tags, it has been known (as in U.S. Pat. No. 5,005,125, for example) to provide the tags with an alarm arrangement which generates an audible alarm signal upon detection of an attempt to tamper with the enclosure portion of the tag. It is also known to secure detaching units with a lock-and-key arrangement, so that only those having possession of the required key are able to use the detaching units.

The above-referenced co-pending '507 patent application discloses incorporating an RFID chip in a hard EAS tag, and including an RFID receiver in the detaching unit, so that article identifying information can be transmitted from the tag to the detaching unit, and the detaching unit operated to remove the tag only upon verification of the article identifying information. The disclosure of the '507 application is incorporated herein by reference.

It is believed that the invention disclosed in the '507 patent application significantly enhances the security of hard tag detaching apparatus. The invention of the present application allows for additional flexibility in the operation of the detaching unit disclosed in the '507 application, while also providing enhanced security.

OBJECTS AND SUMMARY OF THE INVENTION

It is an object of the invention to prevent unauthorized use of an EAS tag detaching unit.

It is a further object of the invention to provide for enhanced control of an EAS tag detaching unit.

It is still a further object to provide improved flexibility in the operation of an intelligent EAS tag detaching apparatus.

According to a first aspect of the invention, there is provided a detacher apparatus for removing an EAS tag from an article of merchandise, the EAS tag including a first element and a second element, the first and second elements adapted for assembly together by snap connection through the article of merchandise, the EAS tag further including a release mechanism for selectively releasing the snap connection, the detacher apparatus including a housing, a removal mechanism in the housing for selectively actuating the release mechanism of the EAS tag to release the snap connection so that the first and second elements may be separated from each other to detach the EAS tag from the article of merchandise, a control circuit for selectively actuating the removal mechanism, the control circuit being switchable between a first mode of operation and a second mode of operation, the control circuit operating in the first mode to actuate the removal mechanism to actuate the release mechanism of an EAS tag presented at the housing only in response to an identification signal generated by the EAS tag, the control circuit operating in the second mode to actuate the removal mechanism to actuate the release mechanism of the EAS tag presented at the housing in the absence of an identification signal generated by the EAS tag, and circuitry for receiving a conditioning signal for switching the control circuit from the first mode of operation to the second mode of operation.

According to a second aspect of the invention, there is provided a method of operating an EAS tag detacher, the method including the steps of placing the detacher in a first mode of operation in which the detacher operates to separate snap-connected elements of an EAS tag only in response to an ID signal generated by the tag, and transmitting a conditioning signal to the detacher to switch the detacher from the first mode of operation to a second mode of operation in which the detacher separates snap-connected elements of an EAS tag presented for separation in the absence of an ID signal generated by the tag. Preferably, the transmitting step includes transmitting the conditioning signal to the detacher via wireless communication from a hand held transmitter-key device. Alternatively, the conditioning signal may be transmitted to the detacher from a P.O.S. terminal or from another device different from a transmitter-key. The transmitter-key device may have the same form factor as the tags to be detached by the detacher and the transmitting step may include placing the transmitter-key device in a nesting area provided on a top surface of the detacher for receiving EAS tags to be detached.

According to a third aspect of the invention, there is provided an article identification system, including, in combination, a plurality of reusable ID tags for being removably attached to articles to be identified, each of the ID tags including an identification element for transmitting identifying information via radio communication, a detacher device for receiving the identifying information transmitted by the identification elements of the ID tags and for selectively responding to the received identifying information by removing the ID tags from the articles, and at least one transmitter-key device for transmitting a conditioning signal to the detacher device to place the detacher device in a mode of operation in which the detacher device removes an ID tag from a respective article in the absence of identifying information transmitted by the ID tag. The conditioning signal transmitted to the detacher by the transmitter-key device may include identifying information which is logged to indicate the identity of the person utilizing the transmitter-key device to "override" the detacher control function. The logging of the identifying information may consist of storing the identifying information in a point-of-sale terminal or other device interfaced to the detacher device. It is also contemplated that transaction information, including data such as the date and time at which the transmitter-key device is used, the type of article of merchandise for which the conditioning signal is transmitted, and other information, may be logged by storing the transaction information in a memory included in the transmitter-key device and/or in the point-of-sale terminal and/or in another device.

According to a fourth aspect of the invention, there is provided a method of operating an EAS tag detacher, the method including the steps of transmitting a first signal to the detacher to switch the detacher from an inoperative condition to an operative condition, and transmitting a second signal to the detacher to switch the detacher from the operative condition to the inoperative condition.

As an alternative to a transmitter-key device having the same form factor as the hard tags to be detached by the detaching unit, the transmitter-key device may be embodied in the form of a smart card.

The present invention provides for increased flexibility in the use of the detaching unit described in the '507 patent application. According to the present invention, the detaching unit of the prior application, which is subject to control on the basis of ID information transmitted by the tag to be detached, can be "overridden" so as to be operable to detach a tag in which the RFID chip has failed or for which the system fails to recognize the ID information as valid. The present invention also permits the detaching unit of the prior application to be selectively operable to detach tags which lack RFID elements.

BRIEF DESCRIPTION OF THE DRAWINGS

The above and other features, aspects, and advantages of the present invention will become more apparent upon reading the following detailed description in conjunction with the accompanying drawings, in which.

DETAILED DESCRIPTION

Figure 1:
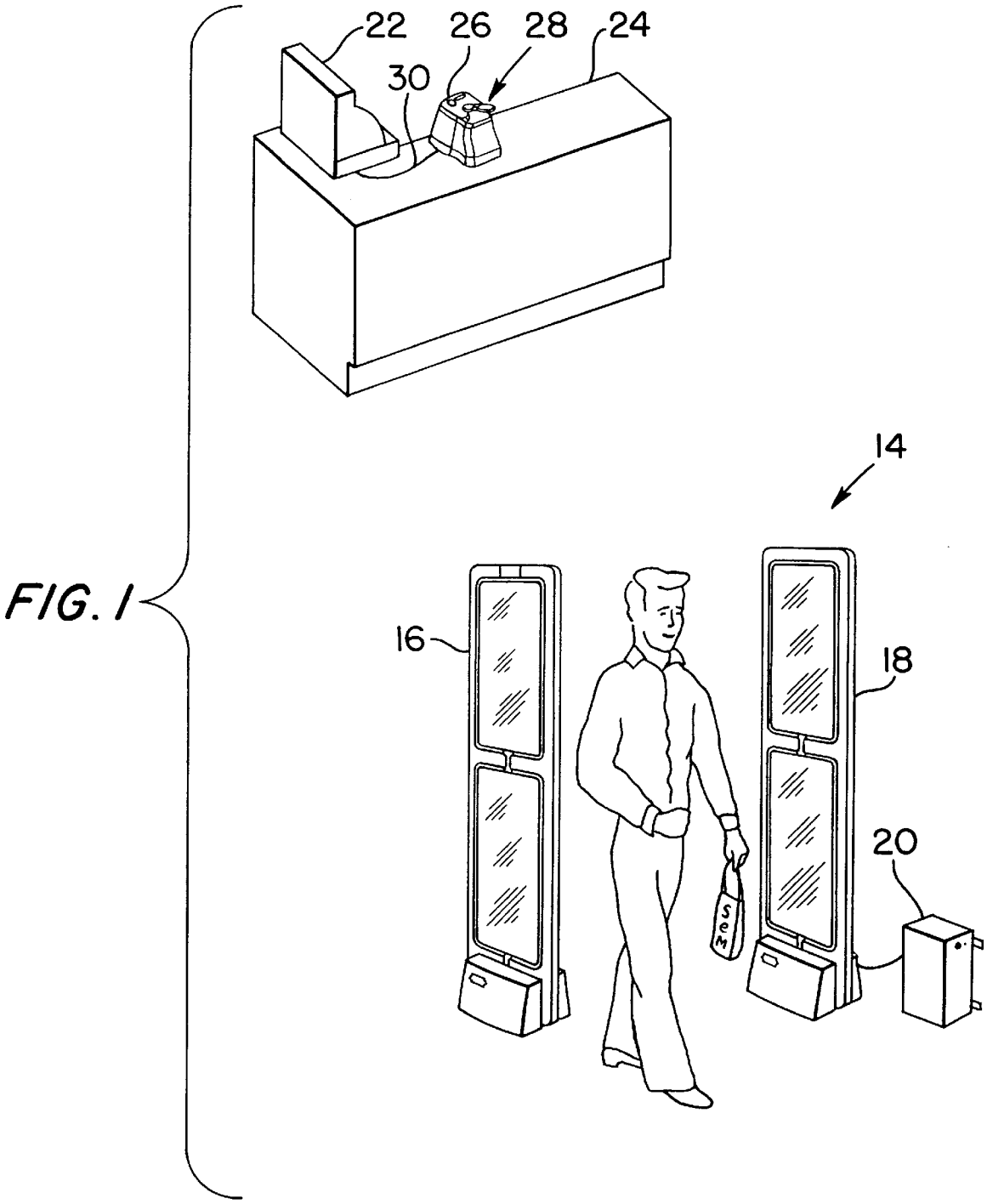
FIG. 1 pictorially illustrates a combined article surveillance and article identification system provided in accordance with the above-referenced '507 patent application.

FIG. 1 pictorially illustrates elements of a combined article surveillance and article identification system installed at a retail store according to the teachings of the '507 patent application. At an exit of the retail store, conventional EAS detection equipment is positioned, generally indicated by reference numeral 14. The EAS detection equipment 14 includes antenna pedestals 16 and 18 and receiver/detection electronics 20. Preferably the EAS detection equipment 14 is of the type used in magnetomechanical EAS systems and sold by the assignee of the present application under the trademark "ULTRA*MAX". Use of other types of EAS equipment is also contemplated.

A point-of-sale terminal 22 is installed at a checkout counter 24. Also present at the checkout counter 24 is a detaching unit 26 which is operable to remove a reusable EAS/ID tag 28 from an article of merchandise (which is not shown). As will be discussed below, the detaching unit 26 also functions as a data reader and writer with respect to the tag 28. Indicated at 30 is a data signal connection provided between the detaching unit 26 and the point-of-sale terminal 22. The point-of-sale terminal 22 is preferably a conventional item, which operates in accordance with customary practices for point-of-sale terminals, except for limited software modifications which will be described below.

Figure 2:
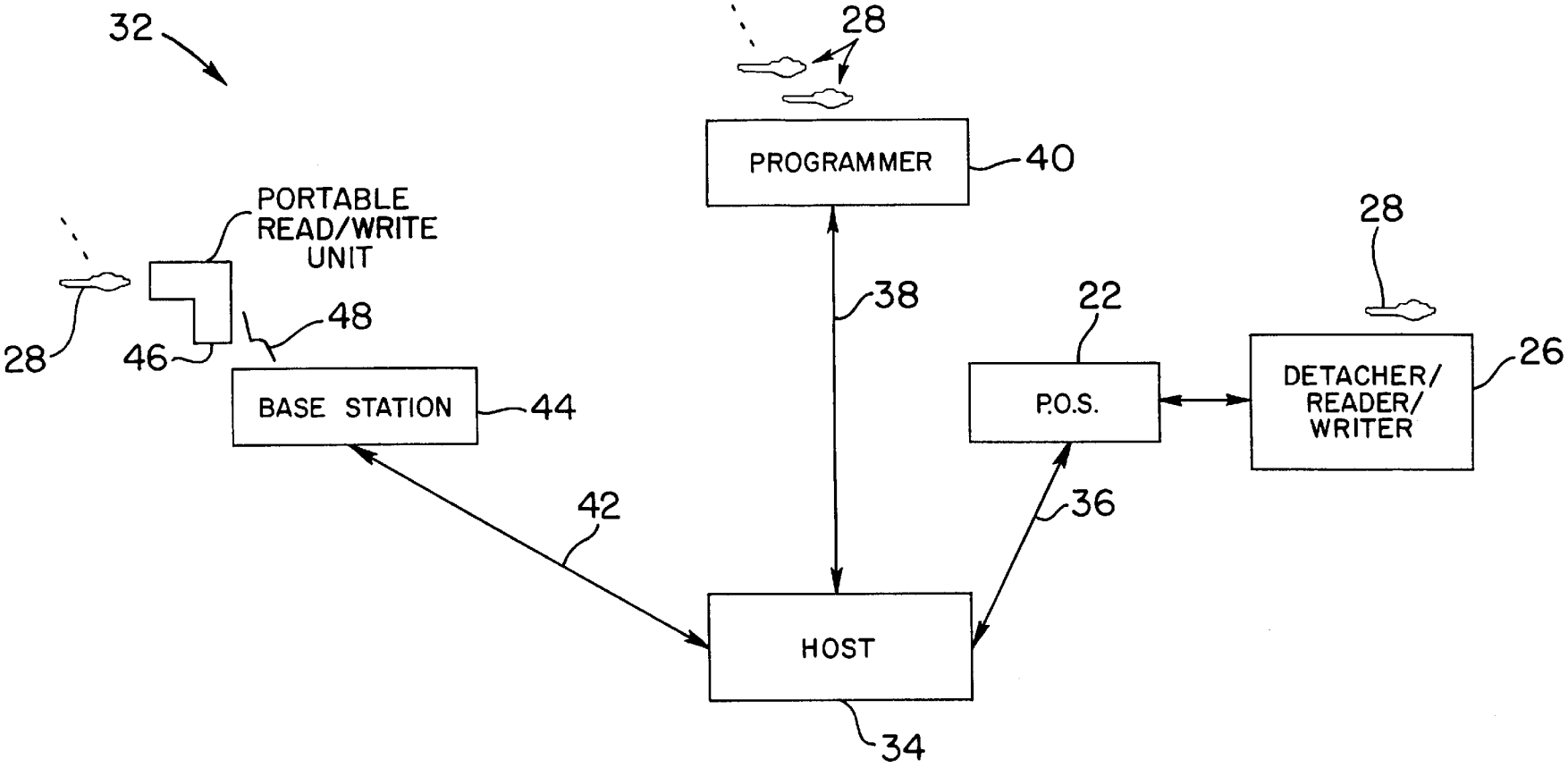
FIG. 2 is a block diagram of article identification system aspects of the combined system of FIG. 1.

FIG. 2 illustrates a data network 32 which links components of the system provided in accordance with the '507 application.

Reference numeral 34 represents a host computer, which stores merchandise identification, inventory, pricing, and other data. A data signal path 36 allows for two-way data communication between the host computer 34 and the above-mentioned point-of-sale terminal 22. A second data path 38 permits data communication between the host computer 34 and a programming unit 40. The function of the programmer 40 is to write product identifying data and other information into EAS/ID tags 28. An additional data signal path 42 permits data communication between host computer 34 and a base station 44 for a portable read-write unit 46. As indicated at 48, a wireless data link permits data to be exchanged between the portable unit 46 and the base station 44.

The function of the portable unit 46 is to read data from tags 28, e.g. for the purpose of taking inventory. The unit 46 preferably also has the capability to write data into the tags 28. For example, the portable unit 46 may be employed to write data into tags 28 at the time when the tags are applied to items of merchandise.

Although only one each of the point-of-sale terminal 22, the programming unit 40 and the portable unit 46 are shown in FIG. 2, it is to be understood that additional POS terminals, programming units and portable read/write units may be included in the system and joined by respective data links to the host computer 34.

Figure 3:
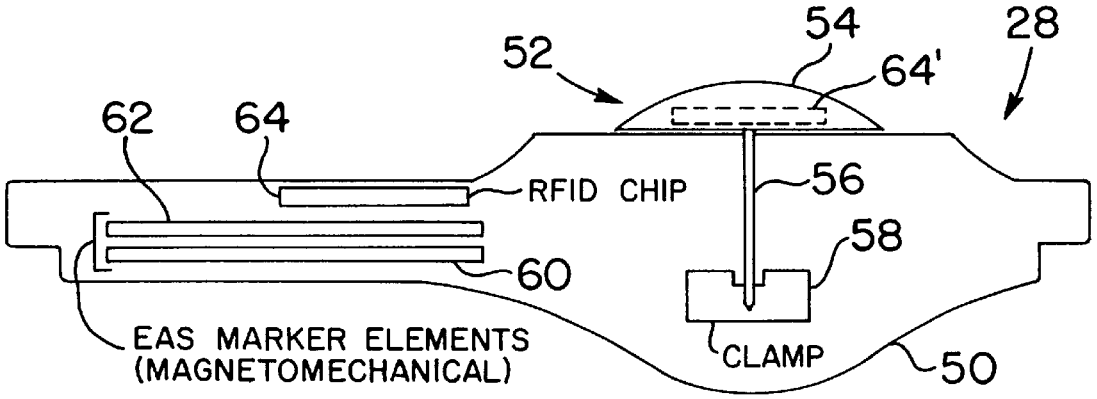
FIG. 3 is a schematic cross-sectional view of a combined article surveillance and article identification tag used with the system of FIG. 1.

FIG. 3 is a schematic cross-sectional view of an EAS/ID tag 28 provided in accordance with the invention, and shows salient features of the tag 28. The largest component of the tag 28 is an enclosure 50, which is at least partially hollow and is preferably formed of molded plastic. A removable tack or pin portion 52 includes a head 54 and a pointed shaft 56 which is inserted into a recessed hole in the enclosure portion 50 and is held by a clamping mechanism 58 mounted in the enclosure portion 50. Housed within the enclosure portion 50 are a magnetostrictive active EAS element 60 and a bias magnet 62. The elements 60 and 62 are preferably like those conventionally employed in magnetomechanical EAS markers, and may be like the corresponding elements disclosed in U.S. Pat. No. 4,510,489. The above-referenced "ULTRA*MAX" magnetomechanical EAS system operates at a standard frequency of 58 kHz, and it is preferred that the resonator element 60 and bias element 62 be selected such that the resonator element has a resonant frequency of substantially 58 kHz. As is known to those who are skilled in the art, conventional magnetostrictive active elements are formed from thin, ribbon-shaped strips of substantially completely amorphous metal-metalloid alloy. In accordance with conventional practice, the bias magnet 62 may be formed of a "semi-hard" or "hard" ferromagnetic material.

Also housed within the enclosure portion 50 of the tag 28 is an RFID chip 64. The RFID chip 64 is capable of storing multi-bit identification data and emitting an identification signal corresponding to the stored data in response to a radio frequency interrogation signal. The RFID chip 64 functions as a transponder in connection with article identification aspects of the article surveillance/identification system described herein. One example of a device which is suitable for service as the RFID chip is the model 210 transponder circuit available from Gemplus, Z.I. Athélia III, Voie Antiope, 13705 La Ciotat Cedex, France. The Gemplus transponder operates at 13 MHz and has considerable data storage capability (well over a thousand characters). This particular transponder circuit is "passive" in the sense that it is powered by the interrogation signal and does not require a battery.

It is preferred that, except for the incorporation of the RFID chip 64, the tag 28 be constituted as a conventional reusable/removable EAS "hard tag". An item that is suitable for modification to provide the tag 28 of the invention, simply by incorporating an RFID chip, is the magnetomechanical hard tag sold by the assignee of the present application under the trademark "SUPERTAG".

As an alternative to housing the RFID transponder in the enclosure portion of the tag, it is contemplated to lodge the RFID transponder in the head 54 of the tack 52, as shown in phantom at 64' in FIG. 3.

Figure 4:
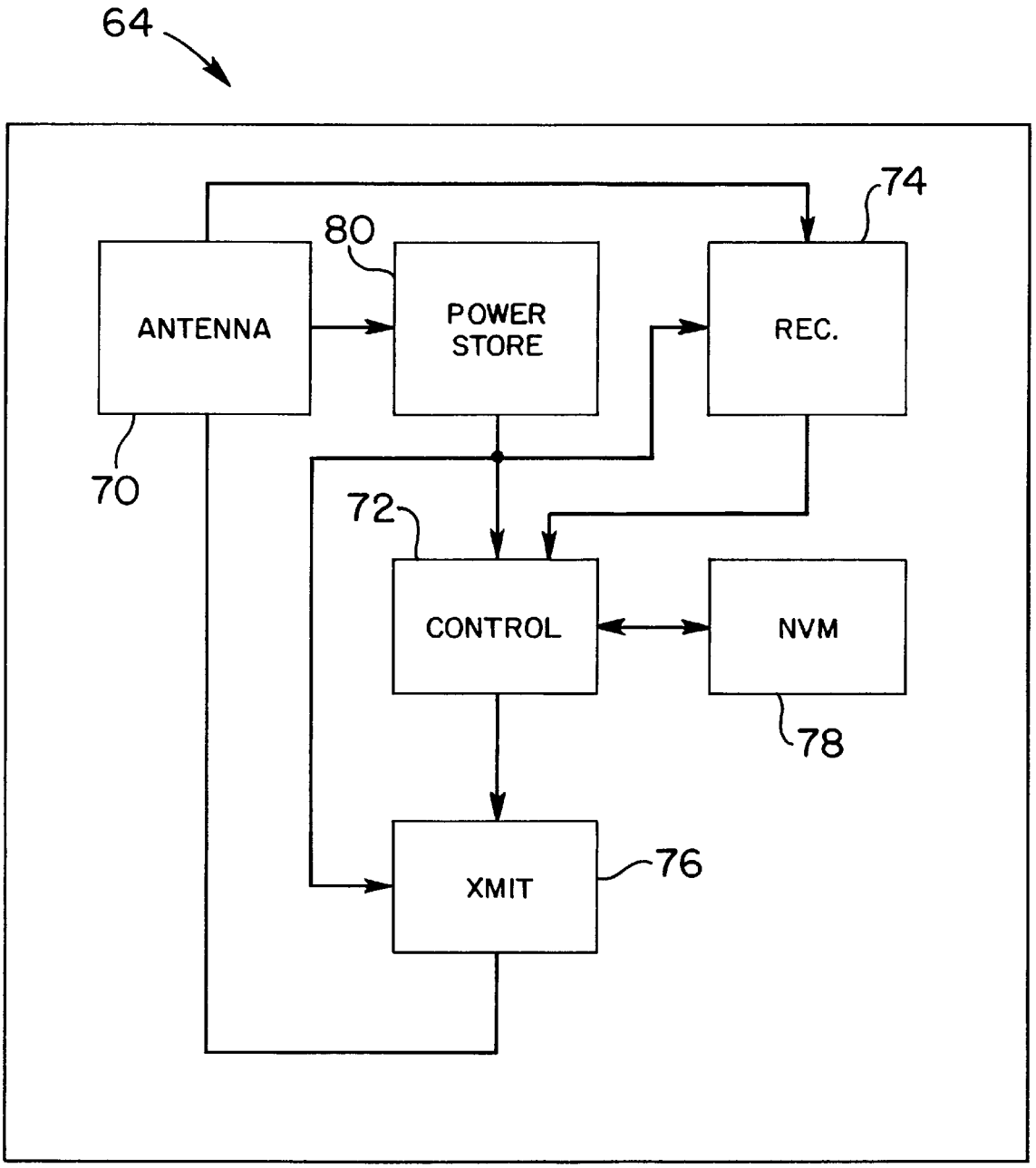
FIG. 4 is a block diagram representation of an RFID chip included in the tag of FIG. 3.

FIG. 4 is a block diagram showing major components of the RFID chip 64. Included in the RFID chip is an antenna structure which is tuned to receive a signal that is at the operating frequency of the article identification system. For example, the operating frequency to which the antenna structure 70 is tuned may be 13 MHz. A control circuit 72 controls the overall operation of the RFID chip. Connected between the antenna 70 and the control circuit 72 is a receive circuit 74, which functions to capture data signals carried by the carrier signal to which the antenna 70 is tuned. In a preferred embodiment of the system, the data signal is generated by an article identification system transmitter by on/off keying of the carrier signal, and the receive circuit is arranged to detect and capture the on-off keyed data signal.

Also connected between the antenna 70 and the control circuit 72 is a transmit circuit 76. Under control by the control circuit 72, the transmit circuit 76 operates to transmit a data signal via the antenna 70. In a preferred embodiment of the RFID chip, the transmit circuit selectively opens or shorts a reactive element (not separately shown) in the antenna structure 70 to provide perturbations in the interrogation signal which are detectable by an article identification system data reader.

Associated with the control circuit 72 is a non-volatile memory 78 which stores data under control of the control circuit 72, and selectively provides stored data to the control circuit 72. The non-volatile memory 78 is preferably used to store identification data which is accessed by the control circuit 72 and used to drive the transmit circuit 76 so that the identification data is output by the RFID chip as an identification signal. Data to update the identification data stored in the non-volatile memory 78 (or additional data indicative of characteristics of the article of merchandise to which the EAS/ID tag is attached, or indicative of handling or sale of the article of merchandise) may be received via the receive circuit 74 and stored in the non-volatile memory 78 by the control circuit 72.

Also included in the RFID chip 64 is a power storage circuit 80 which is connected to the antenna structure 70 and accumulates power from a signal induced in the antenna structure 70 by an interrogation signal applied to the RFID chip. The power storage circuit 80 may include, for example, a storage capacitor (not separately shown). The power storage circuit 80 supplies the power required for operation of the RFID chip.

Figure 5:
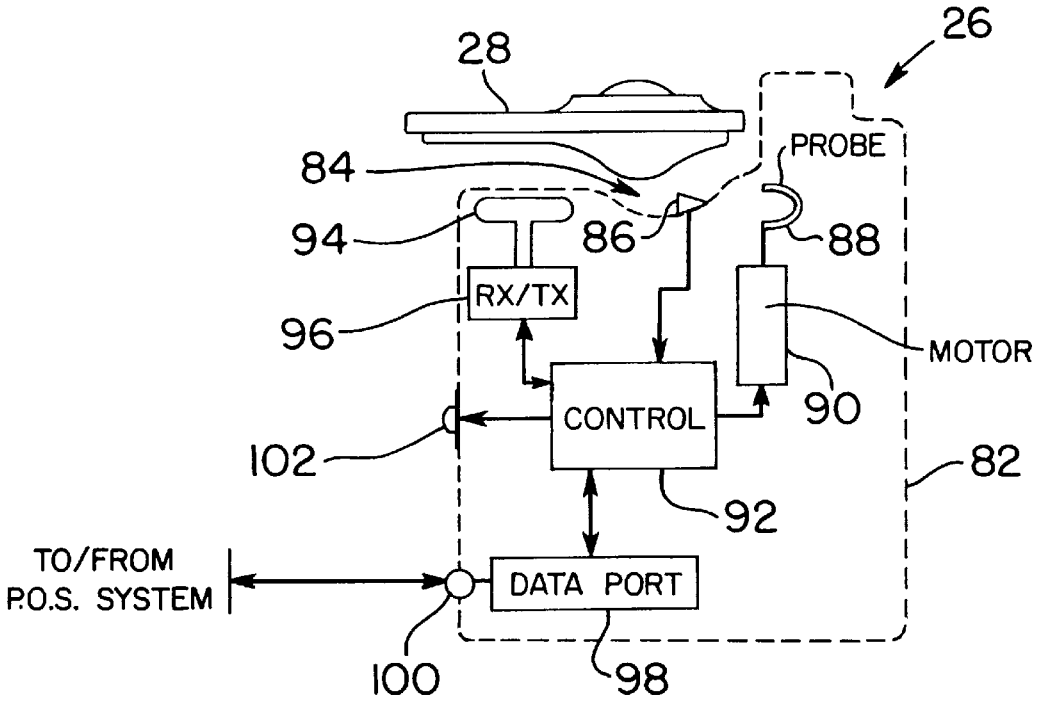
FIG. 5 is a partly schematic cross-sectional, and partly block diagram, representation of a detacher/data read and write unit that is part of the system of FIG. 1.

FIG. 5 shows, in schematic terms, details of the detaching unit 26. The unit 26 includes a housing 82, schematically indicated by dashed lines in the drawing. At a top surface of the housing 82 there is provided a nesting area 84 which is shaped and sized to receive one of the EAS/ID tags referred to above. (In the drawing, one of the tags 28 is shown in a position proximate to the nesting area 84.) A mechanically actuatable switch 86 is mounted in the nesting area 84 to provide an indication that a tag 28 has been positioned in the nesting area 84. Although only one tag detection switch 86 is shown in FIG. 5, it should be understood that at least one additional tag detection switch may be mounted at the nesting area 84, as in the detacher devices of the above-referenced '419, '914, and '606 patents.

The mechanical components of the detaching unit 26, including the housing 82 and the nesting area 84 may be like the corresponding elements of a detacher device marketed by the assignee of the present application, Sensormatic Electronics Corporation, as Model No. MK200, and/or as disclosed in above-referenced U.S. Pat. Nos. 5,426,419; 5,528,914; and 5,535,606. Thus, the probe 88 shown in FIG. 5 may be like the arcuate probe of the above referenced detacher device MK200 and the above-referenced patents, and selectively actuatable by a motor 90 for being inserted into the enclosure portion 50 (FIG. 3) of a tag 28 positioned in the nesting area 84, to release the clamping mechanism 58 of the tag so that the pin portion 52 of the tag may be separated from the enclosure portion 50. It will be appreciated that both the probe 88 and the motor 90 are mounted within the housing 82 of the detaching unit 26.

Referring once more to FIG. 5, a control circuit 92 is mounted within the housing 82. The control circuit 92 may include a conventional microprocessor or microcontroller, with associated program and working memory. The control circuit 92 is connected to control operation of the motor 90, and also receives from the switch 86 a signal to indicate the presence in the nesting area 84 of the tag 28. The control circuit 92 also is operable to interrogate (read) the RFID transponder included in the tag 28, and to write data into the RFID transponder. For this purpose, an antenna 94 is provided in the housing 82 and adjacent to the nesting area 84, and receive/transmit circuitry 96 is provided to interconnect the antenna 94 with the control circuit 92. The antenna 94 is positioned and the receive/transmit circuitry 96 arranged so that the effective range of the unit 26 for reading or writing RFID data is limited to cover only a tag which is in the nesting area 84. This substantially eliminates any problem of interference from other tags that may be present at the checkout counter.

The antenna 94 and the receive/transmit circuitry 96 are arranged to operate at a frequency compatible with the RFID transponder of the tag 28; in the preferred embodiment referred to above, the operating frequency is 13 MHz and an interrogation signal which causes the transponder to output its identification signal is a continuous wave at the operating frequency.

The control circuit 92 is also interfaced via circuitry 98 to a port 100 at the housing 82, so that data signals, command signals and the like may be exchanged between the control circuit 92 and the point-of-sale terminal 22 (FIG. 1). Also present on the housing 82 is a warning lamp 102 which is selectively illuminated by the control circuit 92 to warn of an error condition.

Figure 6:
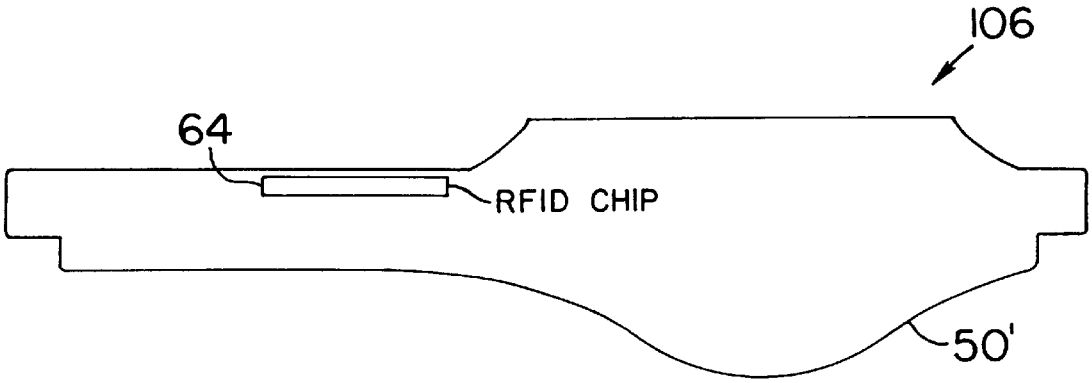
FIG. 6 is a schematic cross-sectional view of a transmitter-key device provided in accordance with the invention for controlling the detacher unit of FIG. 5.

FIG. 6 schematically illustrates a transmitter-key device provided in accordance with the invention to control an "override" operation for the detaching unit of FIG. 5. Reference numeral 106 generally indicates the transmitter-key device. The only essential elements of the transmitter-key device 106 are an enclosure 50' and an RFID chip 64. The enclosure 50' may be essentially the same as the enclosure 50 of the EAS/ID tag illustrated in FIG. 3, but preferably the enclosure 50' lacks the recessed hole provided in the enclosure 50 shown in FIG. 3 for receiving the pin portion of the tag. The RFID chip 64 shown in FIG. 6 may be identical to that shown in FIG. 3, provided that the RFID chip for the transmitter-key device is programmed with identifying data indicative of the "override" function to be performed by the transmitter-key device. It is to be understood that the enclosure 50' shown in FIG. 6 is sized and shaped for nesting in the nesting area 84 (FIG. 5) of the detaching unit, in the same manner as the EAS/ID tags discussed herein.

It should be further understood that, as an alternative embodiment of the transmitter-key device, one of the EAS/ID tags may be employed without modification, except for programming a suitable identification signal into the RFID chip of the tag. If a suitably programmed EAS/ID tag is employed as the transmitter-key device, the pin portion 52 (FIG. 3) and/or the EAS marker elements 60, 62 may be omitted.

The identification signal programmed into the transmitter-key may be specific to the particular key or specific for operation with a particular detacher unit, or may be shared with other keys issued for the same facility, or common to all keys issued by a chain of retail stores. As will be seen, if a key-specific ID signal is used, records may be kept automatically with respect to occasions on which a given transmitter-key is used.

Figure 7:
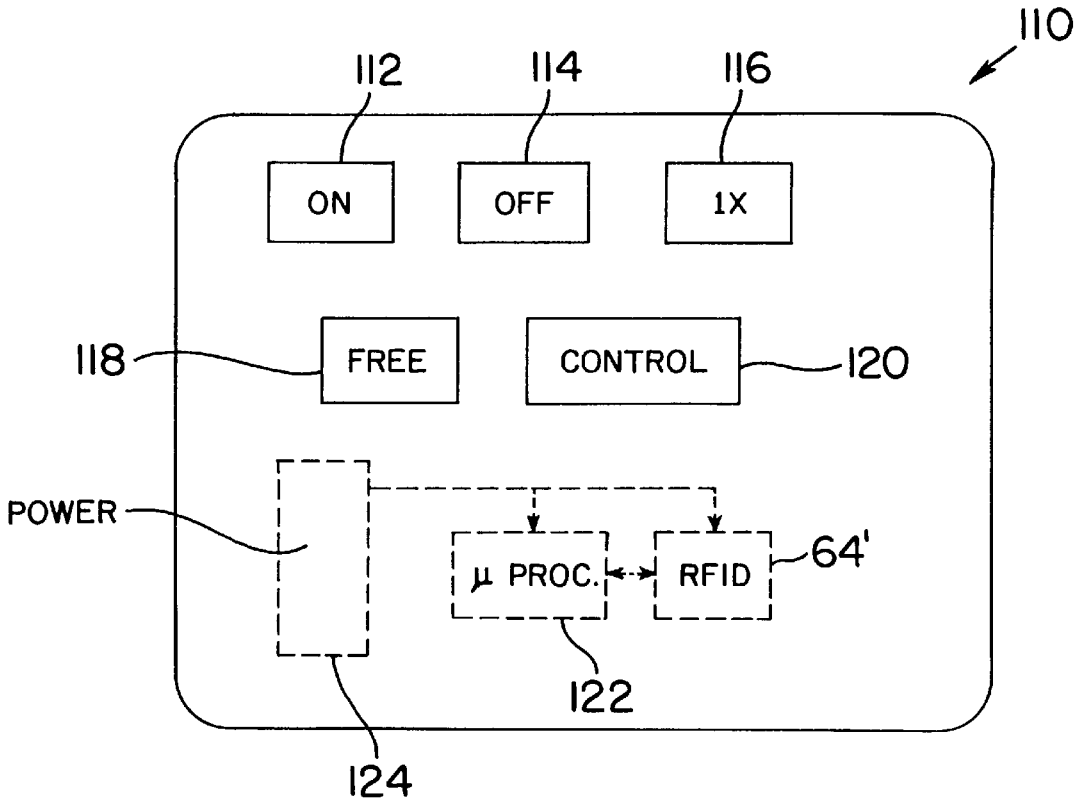
FIG. 7 is a plan view of an alternative embodiment of the transmitter-key device of FIG. 6.

An alternative embodiment of a transmitter-key device is indicated in FIG. 7 by reference numeral 110. The transmitter-key device 110 is in the form of a "smart card", and preferably is of the same shape and size as a standard credit card. FIG. 7 shows the face of the transmitter-key device 110, which includes several control switches 112, 114, 116, 118, 120. The functions of these switches will be described below. The switches may be implemented, for instance, as conventional membrane switches.

Circuit components of the transmitter-key device 110 which are embedded in the device are indicated in phantom and include a microprocessor 122, a power supply (battery) 124 and an RFID chip 64'. The RFID chip 64' of FIG. 7 may be like the chip 64 previously described, but adapted for exchanging data and/or command signals with the microprocessor 122 and for receiving power from the battery. Although not shown in FIG. 7, it should be understood that program and working memory for the microprocessor 122, and other conventional circuitry, are also embedded in the transmitter-key device 110.

Operation of the detaching unit in accordance with the present invention will now be described with reference to FIGS. 8A and 8B, which together form a flow-chart illustration of software which controls the control circuit 92 (FIG. 5).

Figure 8A:
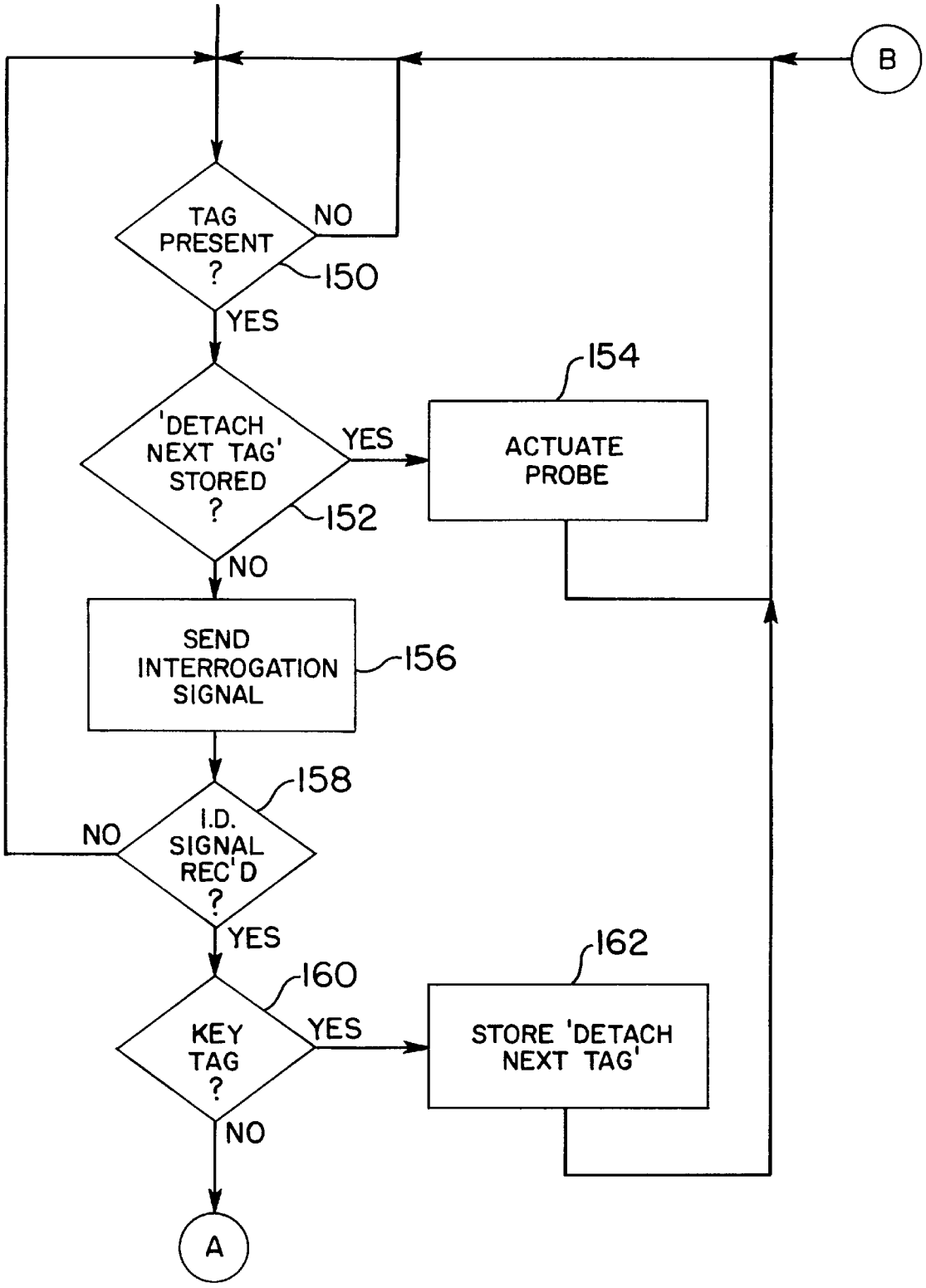
FIGS. 8A and 8B together show a flow chart illustrating software which controls the detacher/read/write unit of FIG. 5 in accordance with teachings of the present invention.
Figure 8B:
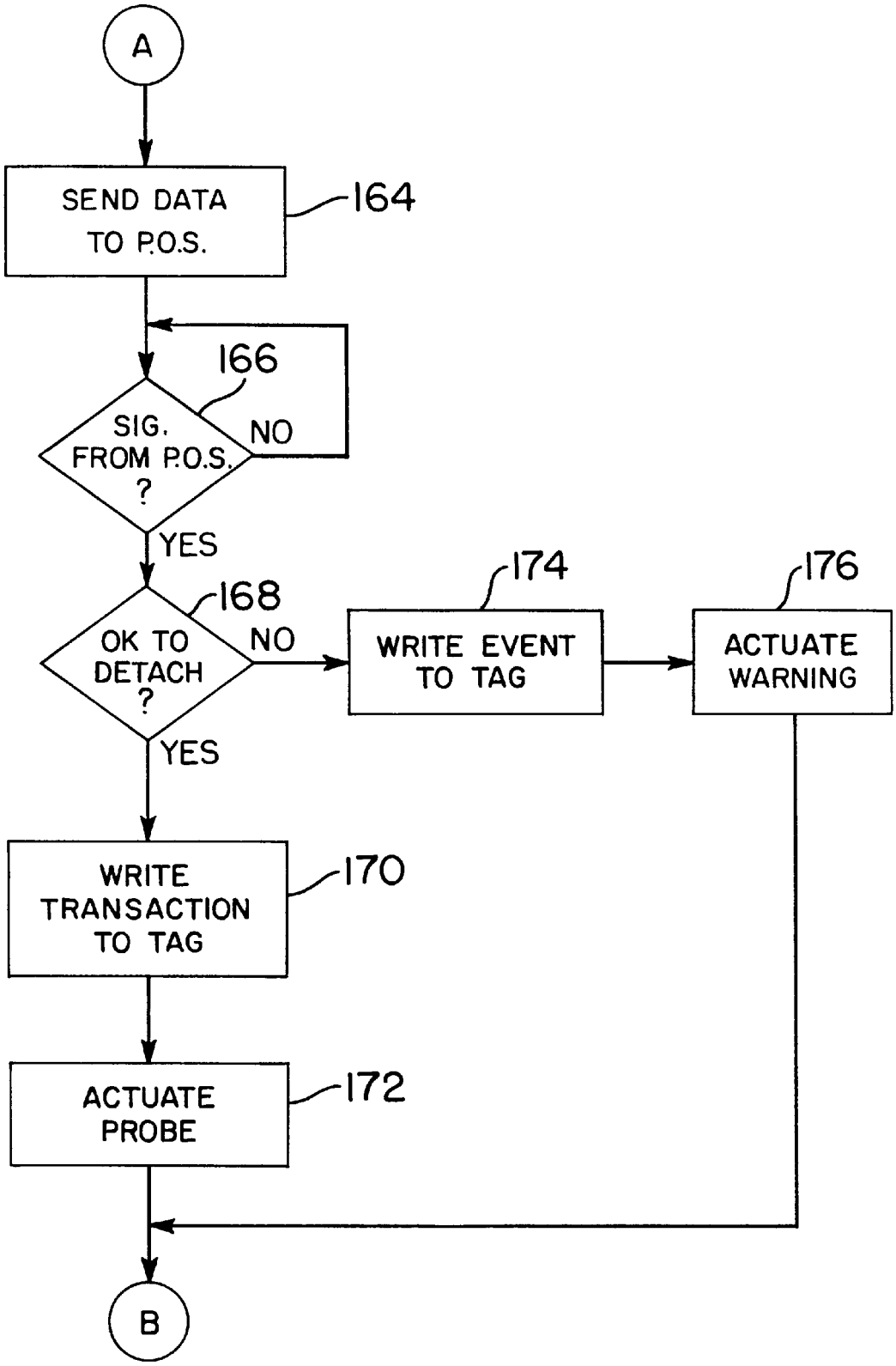

In FIG. 8A, a first step in the process is a determination, represented by block 150, as to whether a tag has been placed in the nesting area 84 of the detaching unit 26. As will be understood from previous discussion, the presence of a tag (or a similarly shaped object, such as the transmitter-key device 106 of FIG. 6) in the nesting area is indicated by a signal provided by the switch 86 which is mechanically actuated by placement of the tag in the nesting area. When the signal indicating the presence of the tag is received, the process advances to step 152, at which it is determined whether a "detach next tag" indication has previously been stored in the control circuit 92. As will be seen from later steps in the process, the "detach next tag" signal is stored in response to insertion of the transmitter-key device into the nesting area of the detaching unit. Assuming that a positive determination is made at step 152, then the process advances to step 154, at which the control circuit 92 causes the motor 90 of the detaching device to insert the probe 88 into the tag to release the connection between the pin and enclosure portions of the tag. The tag can then be removed from the article of merchandise. After step 154, the software process loops back to step 150.

Considering again step 152, if a negative determination is made at that step (i.e. if "detach next tag" has not been stored in the control circuit), then the process advances from step 152 to step 156. At step 156 the control circuit 92 operates to cause the receive/transmit circuit 96 and the antenna 94 to transmit an interrogation signal to stimulate the RFID transponder of the tag (or transmitter-key device, as the case may be) to generate an identification signal. It is next determined, at step 158, whether the identification signal is received. If not, the process loops back to step 150. However, when the identification signal is received, it is then determined, as indicated at step 160, whether the identification signal is that of a transmitter-key device. If so, step 162 follows step 160. At step 162, the above-mentioned "detach next tag" signal is stored by the control circuit 92, and the process loops back to step 150.

From the previous discussion of steps 150, 152 and 154, it will be understood that the transmitter-key identification signal, which leads to the storage of the "detach next tag", functions as a conditioning signal to cause the detaching unit, through operation of steps 150, 152 and 154, to separate the next EAS/ID tag inserted into the nesting area, without requiring receipt or validation of an identification signal from the EAS/ID tag. In other words, the transmitter-key device functions to override the normal operating mode of the detacher unit, which requires receipt of a valid tag ID signal before removing a tag from an article of merchandise.

Referring again to step 160, it will now be assumed that the determination at that step was to the effect that the ID signal received was not that of a transmitter-key device. In that case, the process advances from step 160 to step 164 (FIG. 8B). At step 164, the control circuit 92 forwards the identifying data to the point-of-sale terminal and then waits to receive a signal from the point-of-sale terminal (step 166).

Once a signal from the point-of-sale terminal has been received, the process advances to step 168, at which it is determined whether the point-of-sale terminal has indicated that the detaching unit should operate to remove the tag from the article of merchandise. As will be seen, if the point-of-sale terminal determines that the proposed sale is a valid transaction, it will transmit to the detaching unit a signal indicating that the detaching unit should proceed to remove the EAS/ID tag. This signal will sometimes be referred to as a "trigger signal". If the trigger signal is received by the detaching unit, step 170 follows step 168. At step 170, the control circuit 92 causes the receive/transmit circuit 96 and the antenna 94 (FIG. 5) to transmit data to the RFID transponder of the EAS/ID tag to indicate that the article of merchandise to which the tag is attached has been sold. The data written to the RFID transponder may include, for example, date and time of sale, sale price, an indication as to whether the sale was for cash, check or credit card, credit card number and/or authorization number (if appropriate), location and/or identification number of point-of-sale terminal, identifying information for the sales associate carrying out the transaction, etc. It will be appreciated that some or all of this data may have been generated at the point-of-sale terminal (or upstream, at a host computer) and transferred to the detaching device 26.

Following step 170 is step 172, at which the control circuit 92 causes the motor 90 to insert the probe 88 into the tag to release the connection between the pin and enclosure portions of the tag. The tag can then be removed from the article of merchandise and the transaction is complete.

If at step 168 the point-of-sale terminal did not indicate that the tag was to be removed from the article of merchandise, then step 174 follows step 120. At step 174, the control circuit 92 writes data into the RFID transponder of the tag, via receive/transmit circuitry 96 and antenna 94, to indicate that an unauthorized transaction has been attempted. Information indicative of the date, time, location, etc. of the attempted transaction may be included in the data written to the RFID transponder.

Following step 174 is step 176, at which the control circuit 92 illuminates the warning lamp 102 to indicate that removal of the tag is not authorized and will not be carried out by the detaching unit. The process then loops back to step 150 (FIG. 8A) without actuating the probe to release the pin portion of the tag from the enclosure portion of the tag.

As indicated above, the transmitter-key device may be implemented in the form of a smart card, as shown in FIG. 7. The transmitter-key embodiment of FIG. 7 includes switches 112, 114, 116, 118 and 120 which may be actuated by a holder of the transmitter-key device to transmit respective control signals to the detaching unit. The "on" switch 112 actuates a signal to switch the detaching unit from an inoperative or sleep mode to an operative mode. The "off" switch 114 switches the detaching unit from an operative condition back to the sleep mode. The "one time" (1×) switch 116 functions like the previously described transmitter-key device of FIG. 6 to condition the detaching unit (when in an operative condition) to detach the next tag presented even in the absence of a valid interrogation signal.

The "free" switch 118 is used to generate a "free" signal to switch the detaching unit from an operating mode in which valid ID signals are required for tag removal to a "free" mode, in which no such signals are required. In other words, the "free" signal conditions the detaching unit to detach all tags presented for separation without interrogating the tags and without requiring a valid identification signal to be transmitted by the tag. The "control" switch 120 generates a signal to switch the detaching unit back into the operating mode in which either valid interrogation signals must be provided by the tags for detachment to occur, or a "one time" conditioning signal must have been provided.

Figure 9:
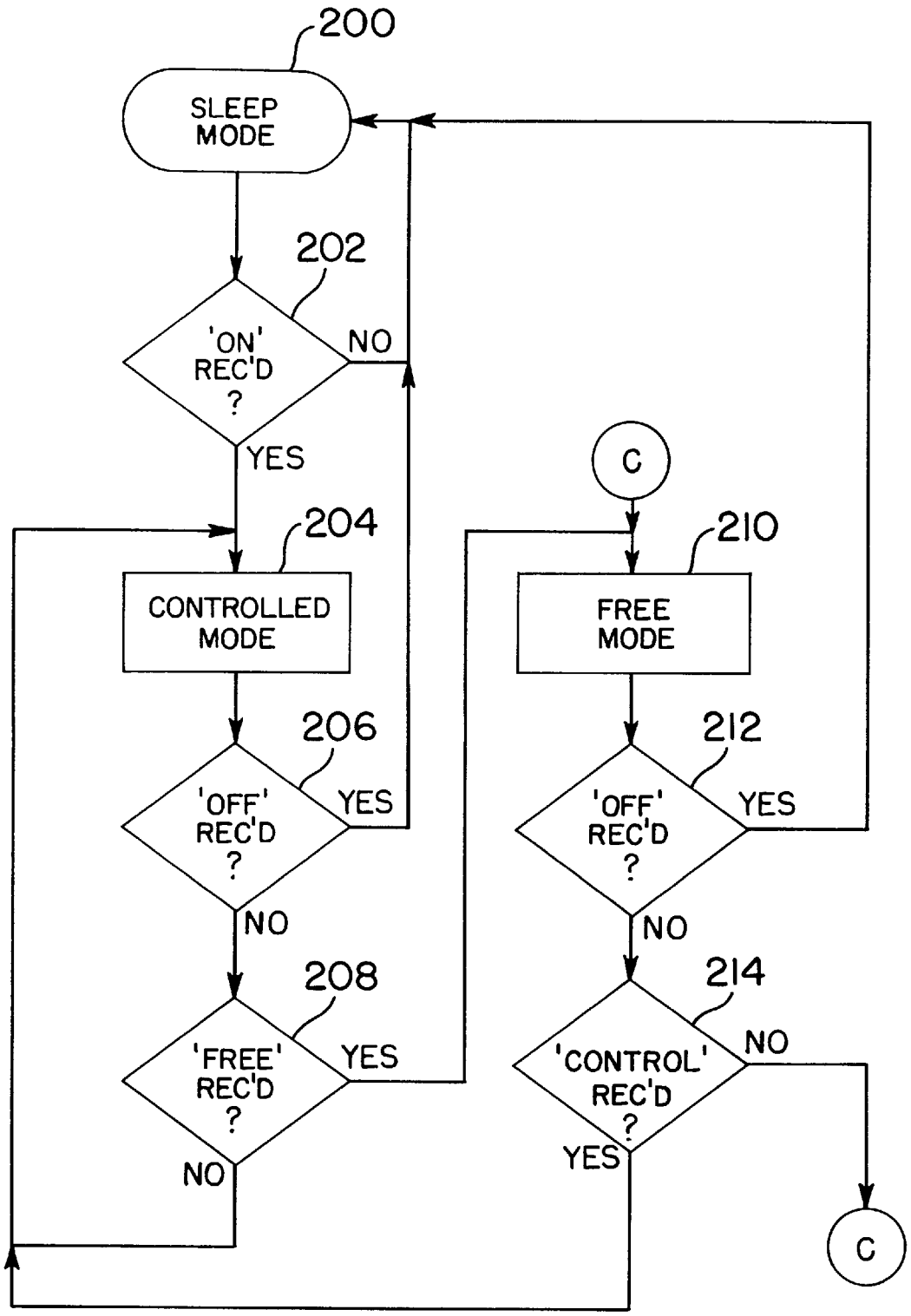
FIG. 9 is a flow chart illustrating additional software for controlling the detacher unit when the transmitter-key device of FIG. 7 is employed.

FIG. 9 is a flow chart which illustrates software for controlling the control circuit 92 of a detaching unit intended to be used with the transmitter-key embodiment shown in FIG. 7. The first step shown in FIG. 9 is step 200, which corresponds to a "sleep mode" in which the detaching unit is not operative to perform any function except detecting an "on" signal transmitted from the transmitter-key device. Step 202 is indicative of the control circuit waiting to receive the "on" signal.

Once the "on" signal is received, the control circuit enters into the "control" mode of operation, as represented by block 204 in FIG. 9. This mode of operation essentially corresponds to the process illustrated in FIGS. 8A and 8B and described hereinabove. In connection with this process, the "one time" signal corresponding to switch 116 shown in FIG. 7 results in storage of the "detach next tag" signal referred to in connection with steps 162 and 152 in FIG. 8A.

The control mode of operation continues unless and until either the "off" signal is received (as indicated at step 206) or the "free" signal is received (as indicated at step 208). If the "off" signal is received, then the detaching unit returns to the sleep mode (step 200). If the "free" signal is received, then the detaching unit enters into the "free" mode of operation (represented by step 210), in which every tag presented for separation is automatically separated, without interrogating the tag for an identification signal or verifying that the identification signal is valid. It will be noted that the free mode of operation corresponds to the manner of operation of the conventional detachers described in the '419, '914 and '606 patents. The free mode continues unless and until either the "off" signal is received (step 212) or the "control" signal is received (step 214). If the "off" signal is received, then the detaching unit returns to the sleep mode (step 200). If the "control" signal is received, the detaching unit returns to the control mode of operation (step 204).

From the foregoing discussion, it will be understood that the transmitter-key embodiment of FIG. 7 is used for a number of functions. First, the transmitter-key of FIG. 7 is used to switch the detaching unit on and off. In addition, a "one time" conditioning signal can be generated using the transmitter-key to cause the detaching unit to detach the next tag presented, regardless of whether the tag provides a valid identification signal. The transmitter-key of FIG. 7 also is capable of generating a second type of conditioning signal, which causes the detaching unit to indefinitely continue in a mode of operation in which no identifying signal is required to enable detachment of tags. The transmitter-key is also operable to reverse the conditioning signal so that the detaching unit is returned to the mode in which detaching operations are controlled in response to identification data provided by the tags presented for detaching.

Because the transmitter-key of FIG. 7 is used to turn the detaching unit on and off, the conventional lock-and-key arrangement referred to above may be omitted from the detaching unit.

Additional functions, not previously discussed, may also be implemented in connection with the transmitter-key devices. For example, data identifying the transmitter-key device (and hence the person holding the device) can be stored in the detaching unit and/or relayed for storage to the point-of-sale terminal to provide a record of the date, time and individual responsible for turning the detaching unit on or off, and/or the person responsible for overriding the controlled mode of operation of the detaching unit.

Furthermore, at least in the case of "one time" overrides, data corresponding to the item of merchandise from which the tag is detached may be entered into either the point-of-sale system or the transmitter-key device, or both. Entry of data into the transmitter-key device may be via a numeric keypad (not shown) which may be provided on the smart card embodiment of FIG. 7. Alternatively, the data may be entered into the transmitter-key device via RF communication, in which case no numeric keypad would be required. The requirement to enter such data into the transmitter-key device may be enforced by requiring a suitable signal to be input into the detaching unit from the transmitter-key device to confirm entry of the merchandise data before the detaching unit is enabled to perform any further detaching operations after an override operation.

According to an additional feature, data indicative of the particular transmitter-key used to authorize an override operation may be written into the tag which was separated as a result of the override operation.

Although the foregoing discussion has indicated that the detaching unit is arranged to be capable of recognizing signals transmitted from the transmitter-key device, this function may instead be performed at the point-of-sale terminal. In this case, the detaching unit would simply be arranged to relay the relevant data transmitted by the transmitter-key to the point-of-sale terminal, and to await suitable commands downloaded from the point-of-sale terminal.

Operation of the RFID chip 64 incorporated in the EAS/ID tag or the transmitter-key device will now be described with reference to FIG. 10, which illustrates in flow-chart form software which controls the control circuit 72 (FIG. 4) of the RFID chip.

Figure 10:
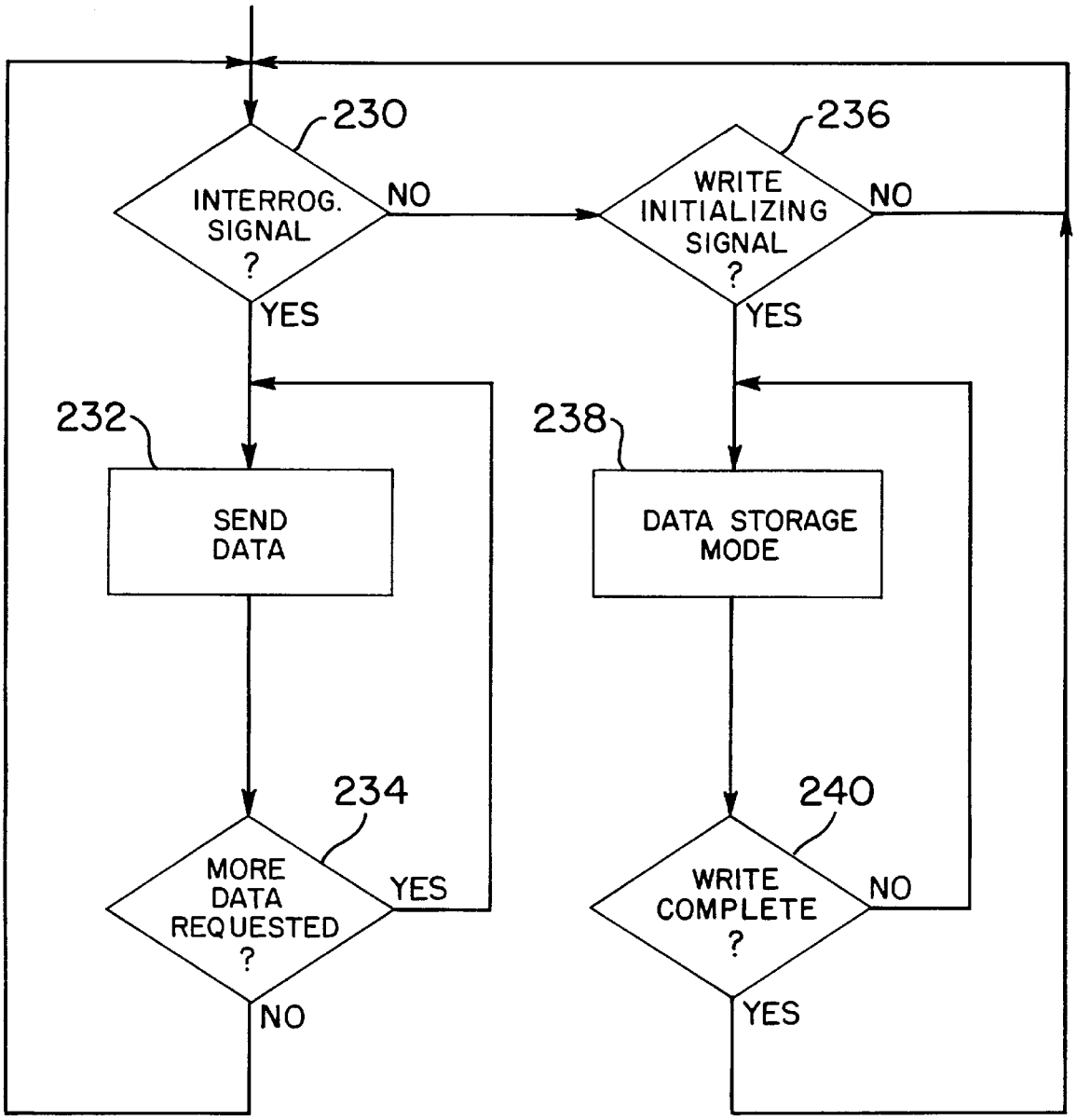
FIG. 10 is a flow chart of software which controls operation of the RFID chip of FIG. 4.

In FIG. 10, it is initially determined whether an interrogation signal is received (step 230). If so, the control circuit 72 retrieves tag ID data from the non-volatile memory 78 and transmits that data as an identification signal by means of transmit circuit 76 and antenna 70 (step 232). As noted before, the data signal may be generated by selectively shorting a reactive element in the antenna so as to form perturbations in the interrogation signal that may be detected by the detaching unit. Following step 232, it is determined whether a signal has been received indicating that additional data is to be transmitted by the RFID chip (step 234). If so, the process loops back to step 232 and the requested additional data is transmitted by the RFID chip. When no more data is requested, the process loops back to step 230.

If at step 230 no interrogation signal was noted, the process advances to step 236, at which it is determined whether a signal is received to indicate that data is to be written into the RFID chip. If such a signal is detected at step 236, then the control circuit 72 enters into a data storage mode (step 238) in which the control circuit receives a data signal via the antenna 70 and the receive circuit 74. The received data signal is stored by the control circuit 72 in the non-volatile memory 78. A preferred embodiment of the RFID chip may include sufficient capacity to store 1,000 to 2,000 characters of information. The information may include transaction identifying information, or information indicative of an unauthorized attempt to remove the tag, as was discussed above in connection with FIG. 8B.

Following step 238 is step 240, at which it is determined whether the operation of writing data into the RFID chip has been completed. If not, the process loops back to step 238. But when the data writing operation is complete, the process loops back to step 230.

Figure 11:
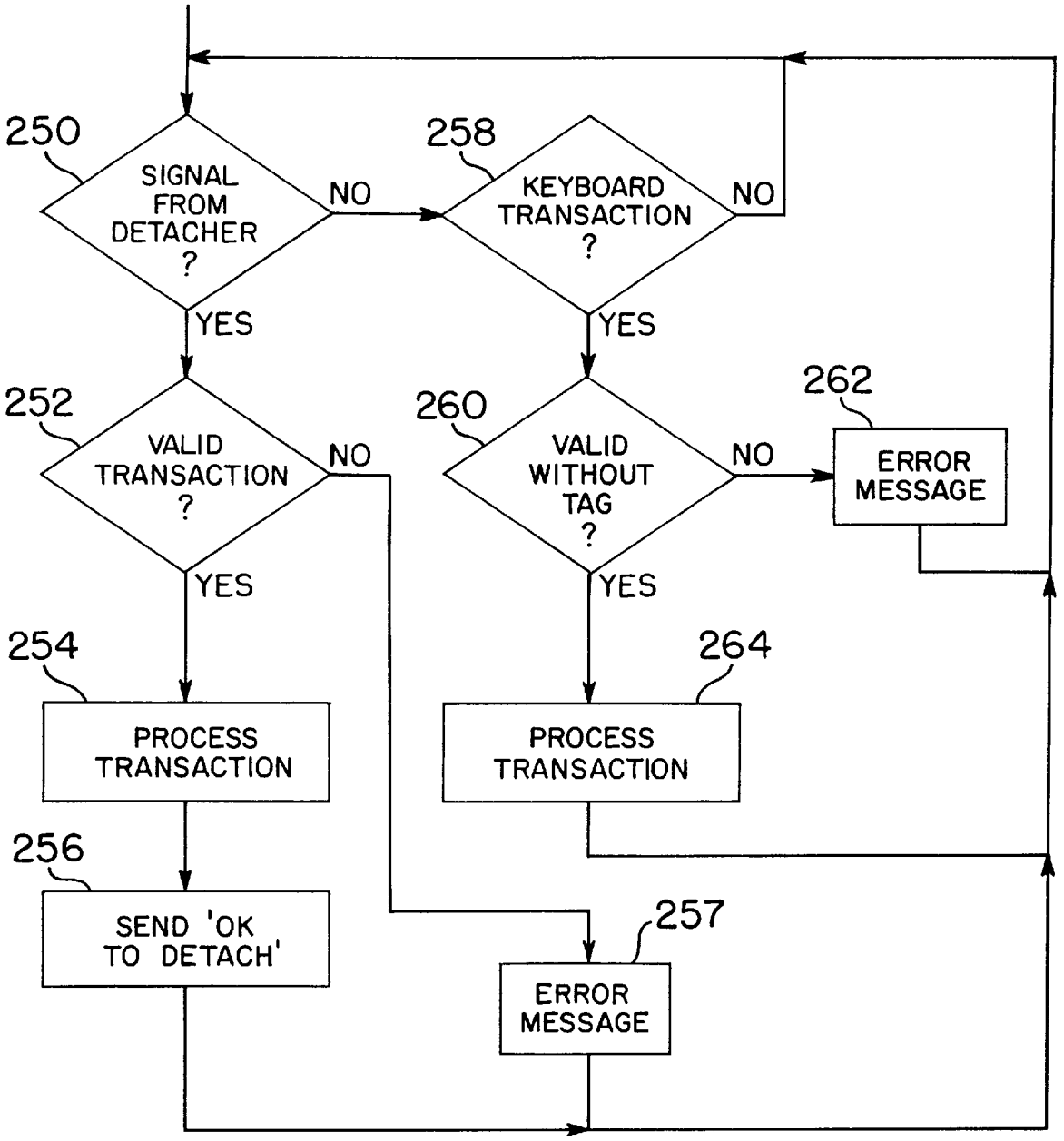
FIG. 11 is a flow chart which illustrates a software routine for a point-of-sale terminal that is part of the system of FIG. 1.

FIG. 11 is a flow chart which illustrates a software modification that may be made to the point-of-sale terminal 22 to provide for interaction between the point-of-sale terminal and the detaching unit. It is to be understood that the point-of-sale terminal is preferably of conventional construction, and is controlled by a microprocessor which is in communication with a host computer via a communication network. Except for software modifications described herein, the point-of-sale terminal may operate in a conventional manner to handle merchandise checkout transactions, validate credit card transactions, and exchange data with the host computer.

In the software module illustrated in FIG. 11, a first step 250 indicates a determination as to whether the point-of-sale terminal has received, from the detaching unit, data indicative of the identity of an EAS/ID tag present at the detaching unit. When such a data message is received by the point-of-sale terminal, it is then determined, at step 252, whether the data represents a valid identification number known to be attached to an article of merchandise available for sale. The determination indicated in step 252 may be based upon information previously stored in the point-of-sale terminal, or accessed from the host computer or another device to which the point-of-sale terminal is connected via a data network. If at step 252 it is found that the identification data received from the detaching unit represents a valid transaction, then the point-of-sale terminal proceeds to process a sale transaction (step 254). The point-of-sale terminal processes the sale transaction in a conventional manner, which may include displaying price and item information, validating a credit card, printing a sales receipt, and reporting the sale transaction to the host computer.

Following step 254 is step 256, at which the point-of-sale terminal 22 sends to the detaching unit 26 a signal (the "trigger" signal) to indicate that the detaching unit should proceed to detach the EAS/ID tag from the article of merchandise. Following step 256 the process loops back to step 250.

If it is determined at step 252 that the data received from the detaching unit does not represent a valid transaction, then the process advances to step 257. At step 257 an error message is generated and the process loops back to step 250, without issuing any instruction to the detaching unit to remove the EAS/ID tag from the article of merchandise.

If at step 250 no tag identification signal was received from the detaching unit, then the process advances from step 250 to step 258. At step 258, it is determined whether input is received from the keyboard of the point-of-sale terminal to indicate that a transaction is to be performed. If not, the process simply loops back to step 250. However, if keyboard input to initiate a transaction is received in the absence of a tag ID signal reported by the detaching unit, then step 260 follows step 258. At step 260, it is determined whether the transaction requested via the keyboard is of a type that is authorized in the absence of a tag ID signal. If not, an error message is generated (step 162) and the process loops back to step 250 without consummating the proposed transaction. However, if at step 260 it is found that the transaction initiated through the keyboard can properly take place without a tag identification signal having been received from the detaching unit (e.g., the item is not subjected to EAS tagging, or the tag in use does not include ID capability), then the point-of-sale terminal proceeds to process the transaction in the normal course (step 264).

As noted before, the data relayed to and verified by the point-of-sale terminal may also include signals indicative of one or more of the "on", "off", "one time", "free" and "control" signals generated by the smart card embodiment of the transmitter-key device, or the identification signal characteristic of the tag-shaped embodiment of the transmitter-key device. The point-of-sale terminal may also operate to generate data to be written into the transmitter-key devices, including data indicative of the timing of override operations and/or data identifying merchandise subjected to an override detaching operation.

Use of the transmitter-key devices in connection with the detaching unit disclosed herein provides a number of advantages. For example, the transmitter-key makes it possible to operate the detaching unit in either one of a controlled mode in which enhanced security is provided by conditioning removal of the tag upon receipt of suitable identifying data, and an uncontrolled mode suitable for use with "dumb" tags (i.e. those lacking an RFID element).

Moreover, the invention allows for convenient switching between controlled and uncontrolled modes. Under normal circumstances, the controlled mode of operation with its attendant security can be maintained; the uncontrolled mode of the detaching unit can be utilized (a) when difficulties in interfacing with the point-of-sale terminal, malfunction of the point-of-sale terminal, or problems in a central data system prevent controlled operation of the detaching unit, or (b) when the detacher is to be used for "dumb" tags.

A transmitter-key device embodied as a smart card also allows for enhanced security in terms of turning the detaching unit on and off, since the identity of the person turning the detaching unit on and off can be logged on the basis of an identification signal provided by the transmitter-key device. The transmitter-key device is also a superior alternative to using a lock-and-key arrangement for overrides, because the transmitter-key makes it possible to log identifying data which indicates the person carrying out the override. It should be understood that the logging of data in connection with an override need not be limited to overriding the controlled operation mode of the detaching unit. Transaction voids or other override operations carried out in the point-of-sale terminal may also be validated and corresponding data logged, by using a transmitter-key device in smart card form. The smart card transmitter-key could also be used to control and/or document employees' logging in to the point-of-sale terminal.

Although separate "on" and "off" signals are utilized in the example given above, as are separate "free" and "control" signals, for switching between free and controlled operating modes of the detaching unit, it should be understood that a single "on/off" signal could be used to toggle between the sleep mode and the operative condition of the detaching unit, and that a single "free/control" signal could be used to toggle between controlled and free modes of operation. In addition, although the free mode of operation was presented in the foregoing example as being of indefinite duration, it is contemplated to provide for a free mode operation that lasts for a predetermined period of time (such as five minutes, or an hour or a day) and then automatically switches back to the controlled mode of operation. The smart card transmitter-key may be arranged to permit the user to pre-program the duration of the free operation mode actuated by the transmitter-key.

The transmitter-key device could also be programmed to limit the number of one-time override operations that could be authorized within a given time period (say, per day or per week). In the case where data identifying the relevant merchandise or other data concerning override operations is stored into the transmitter-key, the resulting data can be downloaded for review at the end of a particular period of time so that the activities of the holder of the transmitter-key are subject to scrutiny.

The smart card embodiment of the transmitter-key device was shown as including a battery. However, it is contemplated to operate the smart card version of the transmitter-key device entirely by power stored from an incident RF field generated by the detacher device or another device. Accordingly, it is not necessary to include a battery in the smart card version of the transmitter-key device.

It is also contemplated that some or all uses of a transmitter-key device may generate an "exception" in terms of operation of the point-of-sale terminal, which may in turn lead to capture of relevant data and/or actuation of closed-circuit video equipment (not shown) which is interfaced to the point-of-sale terminal. The video equipment may be operated to capture and store an image of a person who engages in an override, turns the detacher on or off, switches the detacher to an uncontrolled mode, etc.

It will be understood that the transmitter-key devices described herein provide increased flexibility as well as a number of innovative options for enforcing security with respect to operating both tag detaching units and point-of-sale terminals, while maintaining convenience of use.

Various changes in structure to the described systems and apparatus and modifications in the described practices may be introduced without departing from the invention. Accordingly, it is to be understood that the particularly disclosed and depicted embodiments are intended in an illustrative and not in a limiting sense. The true spirit and scope of the invention are set forth in the following claims.

What is claimed is:

1. Detacher apparatus for removing an EAS tag from an article of merchandise, the EAS tag comprising a first element and a second element, the first and second elements adapted for assembly together by snap connection through the article of merchandise, the EAS tag further comprising release means for selectively releasing said snap connection, the detacher apparatus comprising:

a housing;

removal means, in said housing, for selectively actuating said release means of the EAS tag to release said snap connection so that said first and second elements may be separated from each other to detach the EAS tag from the article of merchandise;

control means for selectively actuating said removal means, said control means being switchable between a first mode of operation and a second mode of operation, said control means operating in said first mode to actuate said removal means to actuate the release means of an EAS tag presented at said housing only in response to an identification signal generated by said EAS tag, said control means operating in said second mode to actuate said removal means to actuate the release means of an EAS tag presented at said housing in the absence of an identification signal generated by said EAS tag; and means for receiving a conditioning signal for switching said control means from said first mode of operation to said second mode of operation.

2. Detacher apparatus according to claim 1, wherein said means for receiving includes an antenna in said housing.

3. Detacher apparatus according to claim 2, wherein said first element of said tag is a rigid label having a recessed hole, and said second element of said tag is a pin having a pointed member adapted to be engaged by said recessed hole, said first element having clamping means, associated with said release means, for releasably engaging said pointed member of said pin, said removal means including probe means for being inserted into an aperture in said rigid label for mechanically actuating said release means to cause said clamping means to release said pin.

4. Detacher apparatus according to claim 3, wherein said housing has a top surface and a nesting area in said top surface for receiving an EAS tag; the apparatus further comprising a switch at said nesting area for being mechanically actuated by an EAS tag inserted into said nesting area, said switch for indicating to said control means the presence of said EAS tag inserted into said nesting area.

5. A method of operating an EAS tag detacher, the method comprising the steps of:

placing the detacher in a first mode of operation in which the detacher operates to separate snap-connected elements of an EAS tag only in response to an ID signal generated by the tag; and transmitting a conditioning signal to the detacher to switch the detacher from said first mode of operation to a second mode of operation in which the detacher separates snap-connected elements of an EAS tag presented for separation in the absence of an ID signal generated by the tag.

6. A method according to claim 5, wherein said transmitting step includes transmitting said conditioning signal to the detacher via wireless communication from a transmitter-key device.

7. A method according to claim 6, wherein said transmitting step includes placing the transmitter-key device in a nesting area provided on the detacher.

8. An article identification system, comprising, in combination:

a plurality of reusable ID tags for being removably attached to articles to be identified, each of the ID tags including an identification element for transmitting identifying information via radio communication;

a detacher device for receiving the identifying information transmitted by the identification element of the ID tags and for selectively responding to the received identifying information by removing the ID tags from the articles; and at least one transmitter-key device for transmitting a conditioning signal to the detacher device to place the detacher device in a mode of operation in which the detacher device removes an ID tag from a respective article in the absence of identifying information transmitted by the ID tag.

9. A system according to claim 8, wherein said ID tags and said at least one transmitter key device all have substantially the same external configuration.

10. A system according to claim 8, further comprising a detection device, positioned at an exit of controlled premises, for detecting unauthorized removal of ID tags from the controlled premises.

11. A system according to claim 10, wherein each of the ID tags includes a marker element separate from the respective identification element of the tag, said marker element for triggering the detection device to generate an alarm signal.

12. A system according to claim 8, wherein said at least one transmitter-key device includes a plurality of transmitter-key devices, each transmitting a respective conditioning signal which includes data for uniquely identifying the respective transmitter-key device;

the system further comprising logging means responsive to said conditioning signals for storing information indicative of each occasion when a respective transmitter-key device transmits its conditioning signal to the detacher device.

13. Detacher apparatus for removing an EAS tag from an article of merchandise, the EAS tag comprising a first element and a second element, the first and second elements adapted for assembly together by snap connection through the article of merchandise, the EAS tag further comprising release means for selectively releasing said snap connection, the detacher apparatus comprising:

a housing;

removal means, in said housing, for selectively actuating said release means of the EAS tag to release said snap connection so that said first and second elements may be separated from each other to detach the EAS tag from the article of merchandise;

control means for selectively actuating said removal means, said control means being switchable between a first mode of operation and a second mode of operation, said control means operating in said first mode to actuate said removal means to actuate the release means of an EAS tag presented at said housing only in response to a trigger signal generated by a device external to said detacher apparatus, said control means operating in said second mode to actuate said removal means to actuate the release means of an EAS tag presented at said housing in the absence of said trigger signal; and means for receiving a conditioning signal for switching said control means from said first mode of operation to said second mode of operation.

14. Detacher apparatus according to claim 13, wherein said control means operates in said second mode to actuate said release means in response to actuation of a switch mounted on said housing.

* * * * *